US006527138B2

(12) United States Patent
Pawlo et al.

(10) Patent No.: US 6,527,138 B2
(45) Date of Patent: Mar. 4, 2003

(54) MEDICATION DISPENSER FOR DISPENSING FLAT DOSAGE FORMS

(75) Inventors: George R. Pawlo, Long Valley, NJ (US); Gary Santonastaso, Belle Mead, NJ (US); Ramaswamy Murari, Hillsborough, NJ (US); Suggy Chrai, Cranbury, NJ (US)

(73) Assignee: Delsys Pharmaceutical Corp., Monmouth Junction, NJ (US)

( * ) Notice: Subject to any disclaimer, the term of this patent is extended or adjusted under 35 U.S.C. 154(b) by 0 days.

(21) Appl. No.: 10/122,808

(22) Filed: Apr. 15, 2002

(65) Prior Publication Data

US 2002/0108963 A1 Aug. 15, 2002

Related U.S. Application Data

(62) Division of application No. 09/602,314, filed on Jun. 23, 2000, now Pat. No. 6,394,306.

(51) Int. Cl.[7] ..... B65H 3/58
(52) U.S. Cl. ..... 221/26; 221/71
(58) Field of Search ..... 221/26, 25, 70, 221/71, 74, 7, 2; 206/530, 534

(56) References Cited

U.S. PATENT DOCUMENTS 2,587,928 A * 3/1952 Tuck ..... 206/445
4,274,550 A * 6/1981 Feldstein ..... 221/71
5,921,433 A * 7/1999 Friar et al. ..... 221/25

* cited by examiner

*Primary Examiner*—Kenneth W. Noland
(74) *Attorney, Agent, or Firm*—DeMont & Breyer, LLC

(57) ABSTRACT

A dispenser for storing/dispensing pharmaceutical dosages that are provided in a stamplike (flat) dosage form. In some embodiments, the present dispenser includes a housing for retaining a plurality of stacked, individual "stamp-like" pharmaceutical dosages. Disposed within the housing beneath the dosages is a bias element, such as a helical spring, that urges the dosages towards a dosage delivery port of the housing. From the dosage delivery port, dosages are dispensed through an aperture. In other embodiments, the instant dispenser includes a cylindrical main body for retaining pharmaceutical dosages having a stamp-like dosage form that are collectively organized in a roll. A dosage delivery port depending from the cylindrical main body receives dosages one at a time therefrom. The present dispenser is configured, in various embodiments, for manual, mechanically assisted, or automated dispensing. Moreover, the present dispenser includes, when appropriately automated, control electronics that (1) alert a user of a scheduled dosage, and/or (2) dispense a dosage at a prescribed time or at a prescribed time interval, and/or (3) maintain a dosage record.

17 Claims, 5 Drawing Sheets

FIG. 4
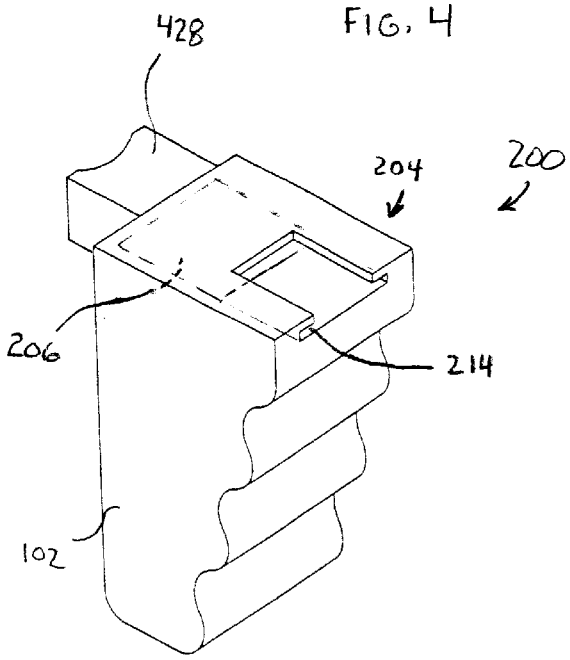
FIG. 5A
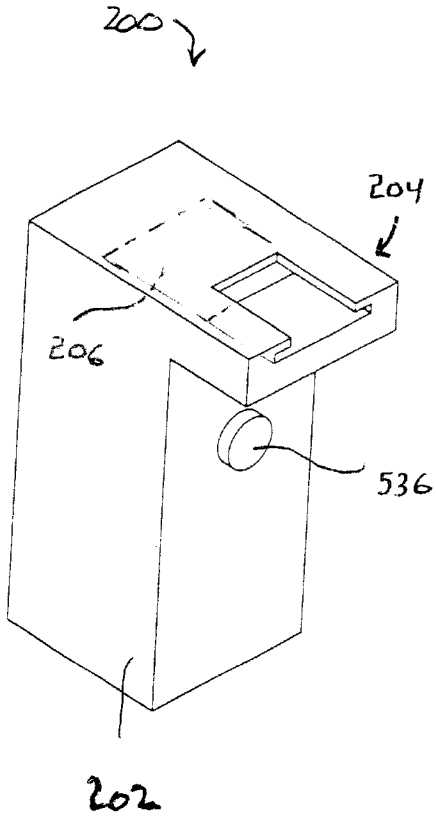
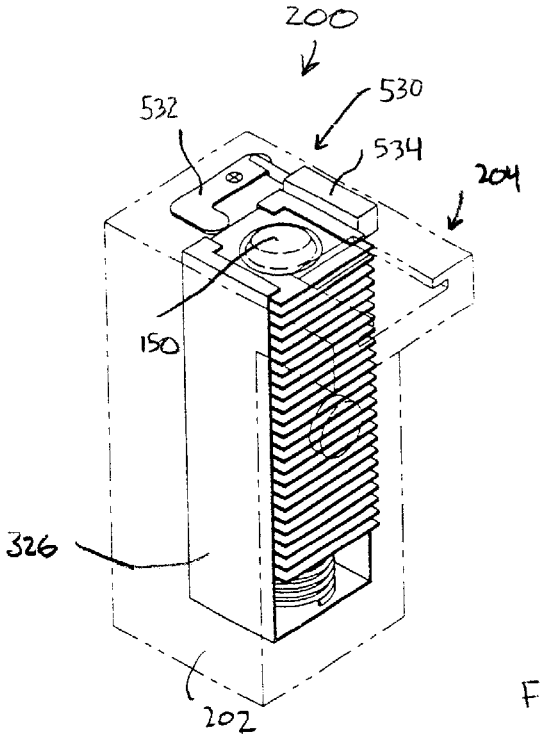
FIG. 5B

MEDICATION DISPENSER FOR DISPENSING FLAT DOSAGE FORMS

STATEMENT OF RELATED CASES

This is a division of, and claims priority of, U.S. Pat. App. No. 09/602,314, now U.S. Pat. No. 6,394,306 filed Jun. 23, 2000.

FIELD OF THE INVENTION

The present invention relates generally to medication dispensers. More particularly, the present invention relates to reusable medication dispensers for dispensing medications having a relatively "flat" dosage form.

BACKGROUND OF THE INVENTION

"Child-proof" medicine containers are a standard method for dispensing prescription drugs. The popularity of such containers is due, of course, to the difficulty that opening such containers presents to children. Ironically, these containers also pose difficulties for groups of people who are most likely to require the medicine that is stored therein. In particular, the aged, the handicapped, stroke victims, arthritis sufferers, individuals that have tremors and those recovering from accidents, surgery or serious disease conditions, among other individuals, may have trouble opening such child-proof medicine containers.

In response to this problem, specialized medication dispensers have been developed. Medication dispensers typically include one or more chambers for storing medicine(s) and various mechanisms for dispensing the medication. In some cases, the dispensers include motors so that when a user pushes a button, a pill is dispensed (see, e.g., U.S. Pat. No. 5,810,198). Some medicine dispensers include electronics that warn a user when it is time to take a pill, some restrict the dispensing of medication to certain prescribed times, and others automatically control delivery of multiple medications (see, e.g., U.S. Pat. Nos. 5,752,620, 4,310,103, and 5,752,621).

Most medication dispensers are designed to dispense small solid dosage forms such as tablets or capsules. If the final dosage form of a medication deviates from those common forms, dispensing may be problematic or impossible via standard dispensers. With the advent of new dosage forms, new types of medication dispensers are required.

SUMMARY OF THE INVENTION

A dispenser for dispensing medications having a flat or "stamp-like" final dosage form is disclosed. In some embodiments, a dispenser in accordance with the present teachings includes a housing for retaining a plurality of stacked individual pharmaceutical dosages. Within the housing and beneath the dosages is a bias element, such as a helical spring, that urges the dosages towards a dispensing end of the housing. The housing also includes a dosage delivery port that receives the pharmaceutical dosages one at a time from the interior of the housing.

In other embodiments, a dispenser in accordance with the present teachings includes a cylindrical main body for retaining a plurality of stamp-like dosages that are collectively organized in a roll. A dosage delivery port depending from the cylindrical main body receives dosages one at a time therefrom.

The dispensing operation for both stacked and rolled dosages can be carried out manually, manually with mechanical assist, or automatically via appropriate actuating mechanisms. In further embodiments, the present dispenser includes electronics that (1) alert a user of a scheduled dosage, and/or (2) dispense a dosage at a prescribed time or at a prescribed time interval, and/or (3) maintain a dosage record.

BRIEF DESCRIPTION OF THE DRAWINGS

FIG. 4 depicts an additional embodiment of a dispenser wherein the dosages are dispensed via a manual actuator.

FIGS. 5A and 5B depict yet another embodiment of a dispenser in accordance with the present teachings wherein the pharmaceutical dosages are dispensed via a mechanized actuator.

DETAILED DESCRIPTION

The assignee of the present application has described a method and an apparatus for making a pharmaceutical unit dosage form or a diagnostic form using electrostatic deposition of biologically- or pharmaceutically-active ingredients. See, International Application PCT/US99/12772, incorporated by reference herein.

Figure 1A:
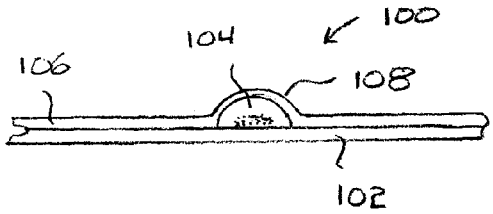
FIG. 1A depicts an electrostatically deposited pharmaceutical dosage form.

In accordance with PCT/US99/12772, unit dosage forms are fabricated by electrostatically depositing pharmaceutically-active powder(s) onto a pharmaceutical-grade substrate and then bonding a cover layer to the substrate over the powder(s). FIG. 1A depicts such a unit dosage form 100. The unit dosage form comprises pharmaceutically-active powder 104 that is disposed between substrate 102 and cover layer 106. Active powder 104 is advantageously disposed underneath bubble 108 in cover layer 106.

In some embodiments, unit dosage forms 100 are incorporated into a secondary package to form any of a number of different "final" or "finished" dosage forms that are disclosed in PCT/US99/12772 or elsewhere. One final dosage form described in PCT/US99/12772 is referred to (therein and herein) as a "stamp" or "stamp-type" or "stamp-like" dosage form. The designation "stamp" acknowledges the resemblance of a diced (i.e., individual) dosage to a postage stamp.

Figure 1B:
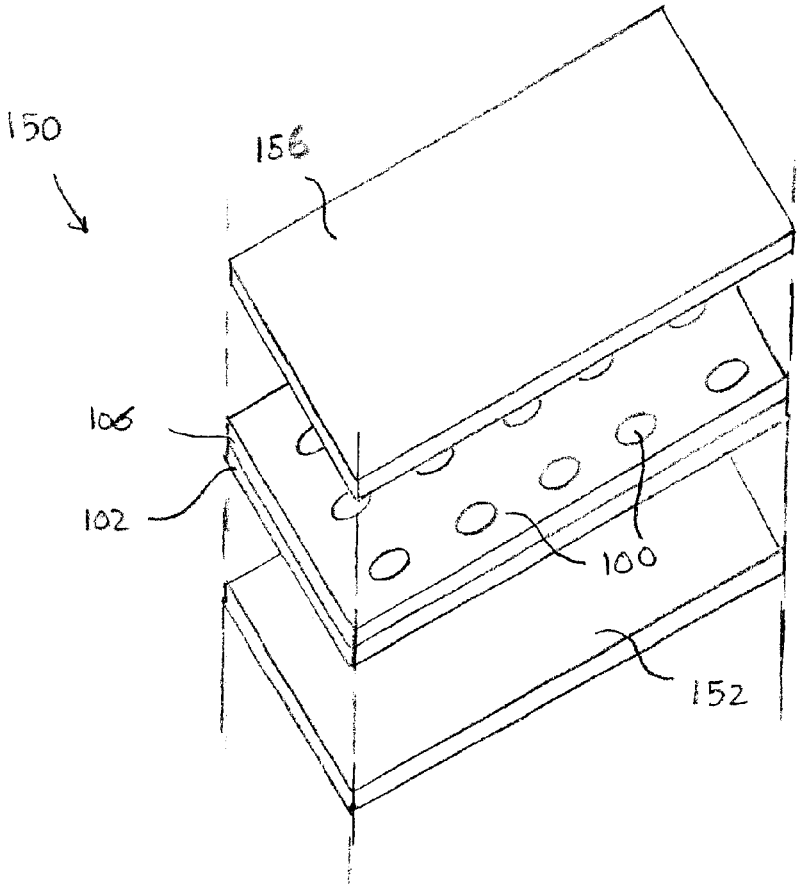
FIG. 1B depicts a strip of stamp-like dosage forms.
Figure 1C:
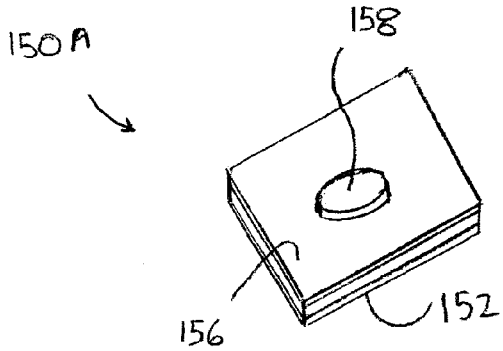
FIG. 1C depicts an individual stamp-like dosage form.

In one embodiment, a stamp-like final dosage form comprises a unit dosage form 100 that is sealed between two polymer-based outer layers 152 and 156 (ie., the "secondary package"). (See FIGS. 1B and 1C.) Typically, many of such unit dosage forms 100 are sealed within the secondary package forming a strip 150 of such stamp-like dosage forms, as depicted via an "exploded" view in FIG. 1B. FIG. 1C depicts an individual dosage form 150C, such as results from dicing strip 150 to separate the individual dosages. In embodiments in which unit dosage form 100 includes bubble 108 (FIG. 1A), layer 156 that overlies cover layer 106 advantageously includes bubble 158 that receives bubble 108.

Stamp-like dosage forms have shapes that are characteristically flat. The diced stamp-like dosage form 150A is advantageously rectangular as shown in FIG. 1C, but it can also be circular or have any suitable shape, as desired. As will become clearer later in this Specification, stamp-like dosages forms may advantageously be organized into a 1×N strip. In embodiments in which stamp-like dosage forms are not diced into individual dosages (e.g., when they are organized in a 1×N strip), the secondary package advantageously has perforations (not shown) between adjacent dosage forms to facilitating removing an individual dosage from the collection thereof.

It will be appreciated that due to its physical configuration, the stamp-like dosage form, whether diced into individual dosage forms or grouped in a strip (both referenced hereinafter by the call out "150"), is not suitable for use in the typical prior art medication dispensers, such as are discussed in the Background section. The present invention provides several embodiments of a dispenser 200 that is suitable for dispensing pharmaceutical dosages that are configured in stamp-like dosage form 150.

As used herein, the term "stamp-like dosage form" includes, in addition to dosage form 150 described above, other final dosage forms that are relatively flat in shape, but that may or may not be electrostatically deposited. In other words, it is not intended that the appended Claims be limited in scope to dosages that are formed via electrostatic deposition and/or to dosages that are sealed into a secondary package. That is, any dosage form that may suitably be dispensed from the present dispenser is considered to be a stamp-like dosage form as that term is used within this Description and the appended Claims. Those skilled in the art will be able to recognize other dosage forms that may suitably be used in conjunction with the present dispenser. Moreover, it will be recognized that while in some embodiments, the dosage comprises a single therapeutic agent, in other embodiments, the dosage comprises multiple therapeutic agents as may be used by patients on more than one therapy. Hereinafter, the term "dosage" and "dosage form" will be used synonymously.

Figure 2A:
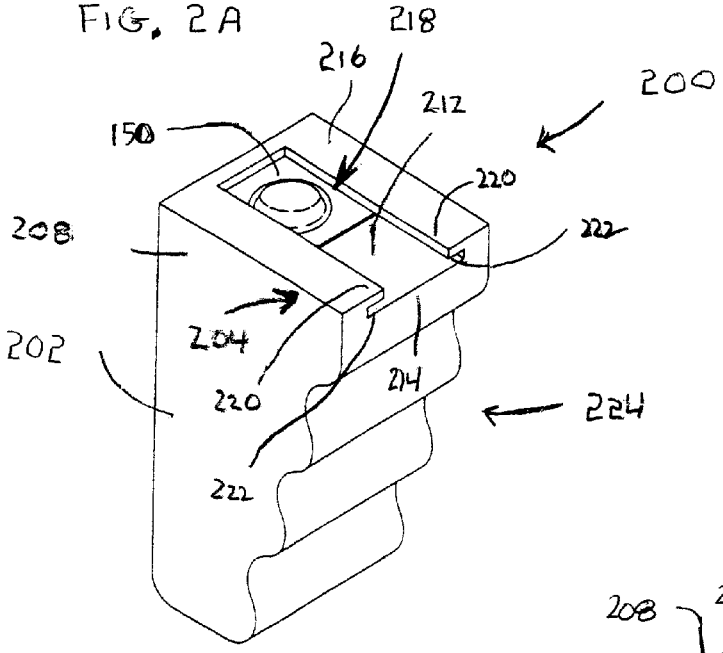
FIGS. 2A and 2B depict an embodiment of a dispenser in accordance with the present teachings.

FIGS. 2A (exterior view) and 2B (interior view) depict a first embodiment of medicine dispenser 200 for dispensing pharmaceuticals having a stamp-like final dosage form. Dispenser 200 comprises housing 202 having dosage delivery port 204. The dosage delivery port 204 receives pharmaceutical dosages 150, one at a time, from the interior of dispenser 200 through portal 206 located at dispensing end 208 of housing 202.

Dosages are urged towards portal 206 via a bias element 210. In the illustrated embodiments, bias element 210 is a helical spring that is placed in compression by dosages 150.

The interior of housing 202 must be suitably configured to retain dosages 150 in a substantially orderly stack so that each dosage 150 is capable of being delivered to portal 206 and then to dosage delivery port 204. In one embodiment, guides (not shown) within housing 202 maintain dosages 150 in stacked arrangement. In another embodiment, the open space within housing 202 takes the form of a shaft (not depicted) that restricts the movement of stacked dosages 150 to only one direction, which is upwards toward dispensing end 208.

Dosage delivery port 204 has a receiving surface 212 that receives dosages 150, one at a time, from portal 206. Receiving surface 212 leads to aperture 214, which is the site from which dosages 150 are dispensed from dispenser 200.

Figure 2B:
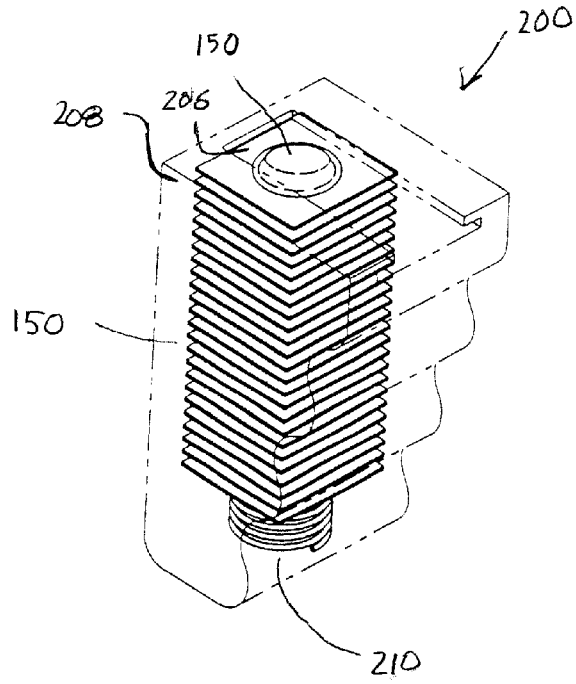

In the embodiment illustrated in FIGS. 2A and 2B, dosages 150 are manually advanced to receiving surface 212 and from there to aperture 214. To facilitate such manual operation, dosage delivery port 204 includes access way 218 through which a user can engage, with a finger, a dosage that is cued in portal 206. Access way 218 is formed in top 216 of housing 202.

Access way 218 is advantageously narrower across than dosages 150. In particular, in the illustrated embodiment, top 216 extends inwardly beyond the side edges of receiving surface 212 thereby forming lips 220. Channels 222 are defined between lip 220 and receiving surface 212 on both sides of dosage delivery port 204. The "side" edges of dosages 150 engage channels 222 so that, among any other benefits, dosages will not fall out of dispenser 200 if it is inverted.

Moreover, the resilience of bias element 210 forces the top-most dosage 150 against the underside of lips 220. Such upward pressure reduces the likelihood that dosages 150 could fall out of dispenser 200.

Dispenser 200 advantageously includes ergonomic features. For example, in the illustrated embodiment, housing 202 includes ergonomic handgrip 224 configured to minimize strain on a user's hand/wrist.

Figure 3:
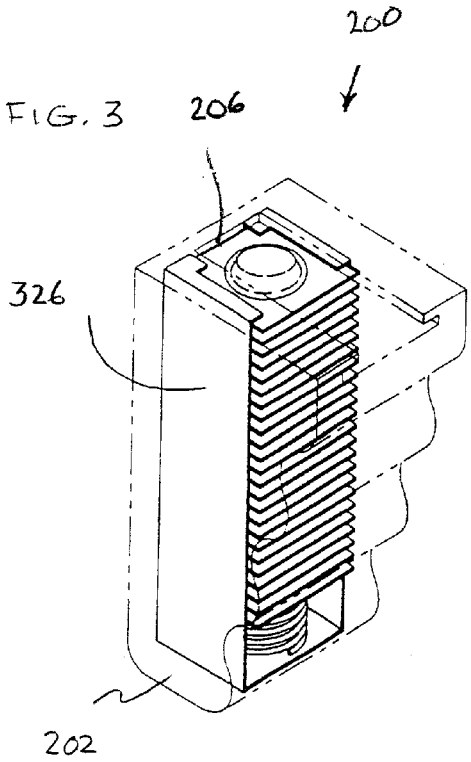
FIG. 3 depicts a further embodiment of a dispenser in accordance with the present teachings wherein the dosages are contained within a removable magazine.

In a second embodiment depicted in FIG. 3, dispenser 200 includes magazine 326 that stores a stack of dosages 150. Magazine 326, which is advantageously removable from housing 202, ensures that dosages 150 remain in an orderly stack within housing 202 for problem-free dispensing. Additionally, it is easier and more convenient to load magazine 326 with dosages 150 (when the magazine is removed from housing 202), than to load a plurality of such dosages directly into the interior of housing 202 as is required for the embodiment depicted in FIGS. 2A and 2B.

In the illustrated embodiment, bias element 210 is disposed within magazine 326. In other embodiments, magazine 326 is physically configured so that bias element 210 is not contained within magazine 326, but, rather, is disposed beneath it. This is accomplished in one embodiment by providing an opening (not shown) in the bottom of magazine 326 that receives bias element 210 and allows it to engage the bottom of the stack of dosages 150. In another embodiment (not depicted), the bottom of magazine 326 is configured to slide within the sidewalls thereof. As dosages are removed from magazine 326 through portal 206, the force imparted by bias element 210 forces the movable bottom of the magazine, and the overlying dosages 150, upwardly. The slideable bottom of magazine 326 nears dispensing end 208 of housing 202 as the full complement of dosages 150 is dispensed therefrom.

In the previous embodiments, dosages 150 are manually advanced to receiving surface 212 and from there to aperture 214. FIG. 4 depicts an embodiment of dispenser 200 according to the present teachings in which a plunger 428 advances a dosage 150 from portal 206 to dosage delivery port 204.

Plunger 428 does not include any mechanism that provides a mechanical advantage or that changes the direction of a manually applied actuating force. A user simply pushes plunger 428, which, in turn, advances dosage 150 from portal 206 into dosage delivery port 204. Plunger 428 is suitably configured, as desired, to advance a dosage either part of the way or completely through aperture 214 of dosage delivery port 204. Dispenser 200 depicted in FIG. 4 can be used with or without magazine 326.

FIGS. 5A and 5B depict an embodiment of dispenser 200 comprising a mechanized actuator 530. Actuator 530 includes arm 532 that is operatively connected to solenoid 534 or like device. A power supply (not shown) supplies power to solenoid 534. When a user pushes button 536, power is sent to solenoid 534, which in turn drives arm 532 into dosage 150 thereby moving it from portal 206 into dosage delivery port 204. To provide sufficient space for actuator 530, housing 202 may be somewhat larger than for the previously described embodiments. Magazine 326 is advantageously used for storing dosages 150 within housing 202.

In some embodiments (not depicted), the mechanized actuator is manually "powered" (i.e., the actuating force is supplied by a user). In such embodiments, actuator 530 comprises mechanical linkages (not depicted) that drive arm 532 into dosage 150 using a force that is applied by a user to button 536. Alternatively, other actuating arrangements that will occur to those skilled in the art may suitably be used.

The previous embodiments of dispenser 200 were directed to diced stamp-like dosage forms (see, FIG. 1C). In further embodiments, the present dispenser is configured for dispensing a strip of stamp-like dosage forms 150.

Figure 6:
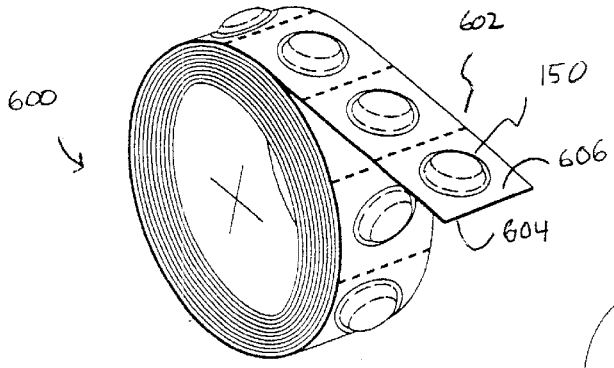
FIG. 6 depicts pharmaceutical dosages having a stamp-like dosage form wherein the dosages are collectively organized in the form of a roll.

FIG. 6 depicts a roll 600 of stamp-like dosage forms 150. Perforations 602 separate each individual dosage 150 to facilitate separating such dosages. In other embodiments (not shown), individuals dosage forms can be disposed on a carrier sheet (e.g., using a weak adhesive), rather than being linked by their secondary package to adjacent dosage forms as depicted in FIG. 6.

Figure 7:
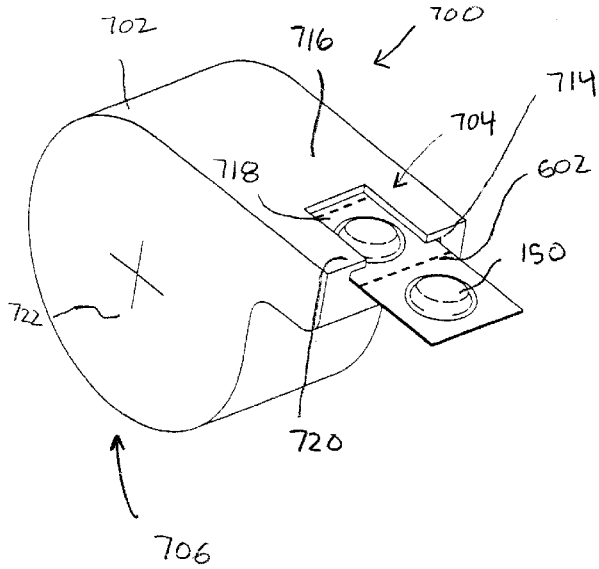
FIG. 7 depicts an embodiment of a dispenser in accordance with the present teachings for manually dispensing the rolled dosages of FIG. 6.

FIG. 7 depicts an embodiment of medicine dispenser 700 for dispensing a roll 600 of dosages 150. Dispenser 700 comprises housing 702 having cylindrical main body 706 suitable for receiving roll 600. Dosage delivery port 704 depends from cylindrical main body 706. Dosages 150 are received at dosage delivery port 704 one at a time from cylindrical main body 706. Dosage delivery port 704 includes aperture 714, which is the site from which dosages 150 are dispensed from dispenser 700.

In the embodiment illustrated in FIG. 7, dosages 150 are manually advanced to dosage delivery port 704 and to aperture 714. To facilitate such manual operation, dosage delivery port 704 includes access way 718 through which a user can engage, with a finger, a dosage that is cued in dosage delivery port 704. Access way 718 is formed in top 716 of housing 702.

Access way 718 in top 716 is advantageously narrower across than pharmaceutical dosages 150. In particular, in the illustrated embodiment, top 716 extends inwardly beyond the side edges of aperture 714 forming lips 720. The "side" edges of dosages 150 advantageously underlie lips 720 so that, among any other benefits, the end of roll 600 nearest aperture 714 will remain within the dispenser until such time as dosage 150 is dispensed.

A side 722 of housing 702 is advantageously removable or otherwise allows access to the interior of housing 702 to allow insertion of roll 600 of dosages 150. In some embodiments, housing 702 contains a removable cartridge (not shown) that receives roll 600 for storage therein.

Figure 8:
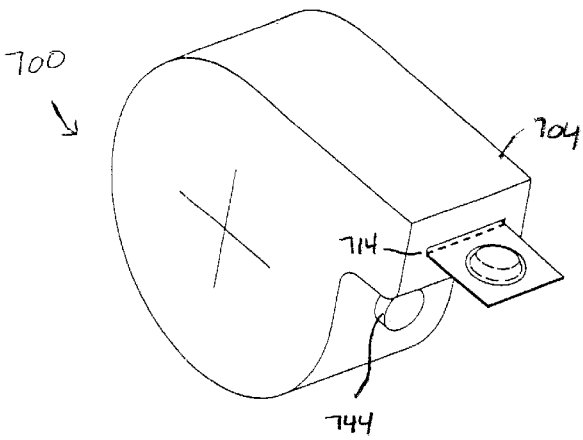
FIG. 8 depicts a further embodiment of a dispenser that is configured for mechanized dispensing of the rolled dosages of FIG. 6.

In the previous embodiment, dispenser 700 did not include any mechanism for advancing dosages 150 toward the dosage delivery port/aperture. In such an embodiment, dosages are dispensed, for example, by inserting a finger through access way 718, engaging dosage 150, and sliding it forward towards aperture 714. FIG. 8 (exterior view) and FIG. 9 (interior view) depict an embodiment of dispenser 700 according to the present teachings comprising a drive mechanism 730 for advancing dosages 150 toward dosage delivery port 704 and aperture 714 for dispensing.

The illustrative dispenser 700 depicted in FIG. 8 is very similar in external configuration to the dispenser depicted in FIG. 7. Since dispenser 700 of FIG. 8 has drive mechanism 730, access way 718 for manually engaging dosages 150 is not required. The dispenser of FIG. 8 includes button 744 that activates the drive mechanism.

Figure 9:
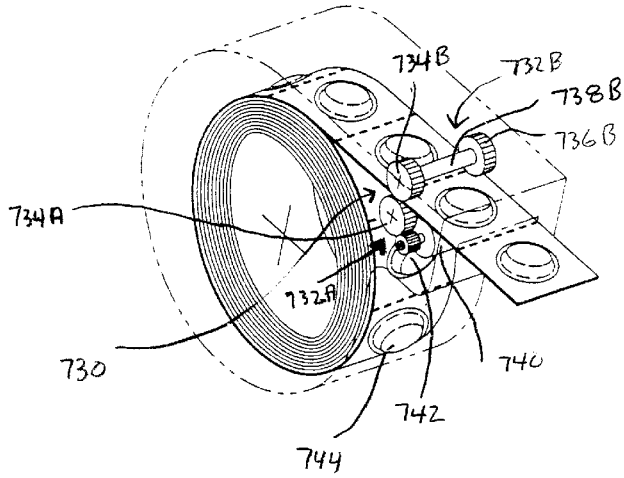
FIG. 9 depicts an illustrative electronically-driven mechanized actuator for dispensing the rolled dosages of FIG. 6.

In an illustrative depicted in FIG. 9, drive mechanism 730 comprises first roller 732A, second roller 732B and motor 740, interrelated as shown. Each roller comprises two wheels (e.g., 734B and 736B) that are rigidly connected by an axle (e.g., 738B). Drive shaft 742 is connected to motor 740 and turns when the motor is energized. A power supply (not shown) supplies power to motor 740.

Wheels 734A and 736A (the latter not shown) of roller 732A engage undersurface 604 (see FIG. 6) of the carrier sheet or secondary package of the dosage forms. Likewise, wheels 734B and 736B of roller 732B engage top surface 606 (see FIG. 6) of the secondary package of the dosage forms. Drive shaft 742 operatively engages wheel 734A.

When a user pushes button 744, power is sent to motor 740. The motor rotates drive shaft 742, which, in turn, drives wheel 734A. Wheel 734A, which must maintain sufficient frictional engagement with undersurface 604, drives dosage forms 150 towards through dosage delivery port 704 and aperture 714. Sufficient frictional engagement is maintained by sandwiching dosage forms 150 between the first and second roller 732A and 732B.

In some embodiments, drive mechanism 730 is manually "powered" (i.e., the actuating force is supplied by a user). In one such embodiment (not depicted), the drive mechanism comprises the two rollers as shown, but not motor 740. Rather, a crank engages, either directly, or through mechanical linkages, one of the rollers. As the crank is turned by hand, the rollers advance dosages 150 through aperture 714. In another embodiment (not depicted), roll 600 of dosages 150 can be wound around a hub, the hub having a crank engaged thereto. As a user turns the crank, the hub turns, thereby advancing dosages 150.

The operation of dispensers 200 and 700 can be enhanced by one or more advanced dispensing features. Such features include, among others, alerting the user to dispense a dosage, timed dispensing, and compliance record keeping. To that end, in further embodiments in accordance with the present teachings, dispensers 200 and 700 include dosing/alarm/monitoring electronics 800, a figurative embodiment of which is depicted in FIG. 10.

Figure 10:
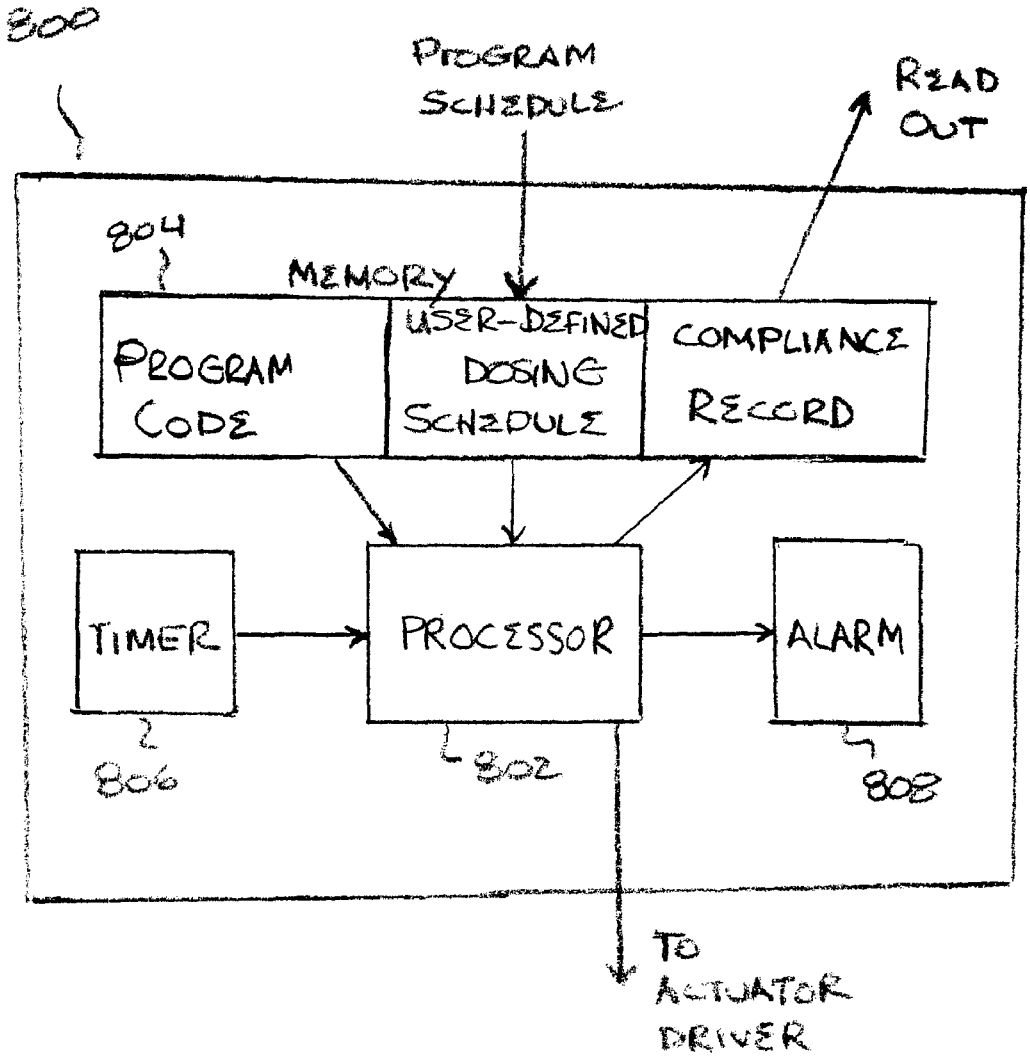
FIG. 10 depicts a simplified block diagram of electronics for imparting dosing, alarm and dose monitoring capabilities to the present dispenser.

In the embodiment depicted in FIG. 10, electronics 800 includes processor 802, memory 804, timer 806 and alarm 808. "Dosing" electronics (i.e., the functionality required for timed dosing) and "monitoring" electronics (i.e., the functionality required for dosage monitoring and recording) include processor 802, memory 804 and timer 806.

In some embodiments, memory 804 is used to store program code for operating the processor 802, to store a user-defined dosing schedule and to store compliance/monitoring data. Memory 804 may comprise at least two separate memory devices since the program code should be in permanent memory while the dosing schedule and compliance data advantageously reside in programmable/erasable memory.

The dosing schedule, which is advantageously programmed by a user into memory 804, can specify that a dosage is to be dispensed at a specific time (e.g., 8:00 a.m.) or, alternatively, can specify that dosages are to be delivered according to a time interval (e.g., every 4 hours). Timer 806 is used in conjunction with the dosing schedule to implement timed dosing.

In accordance with the dosing schedule, processor 802 sends an appropriate actuating signal to the actuator/drive mechanism 530/730 (more properly, to the actuator or mechanism "driver," not depicted). The signal energizes actuator/drive mechanism 530/730 and a dosage is dispensed. Processor 802 advantageously updates the compliance record with information concerning the dispensed dosage (e.g., the time dispensed, etc.). Compliance data can be read out of memory 804 in known fashion.

To automatically dispense dosages according to a defined schedule, dispenser 200 or 700 must include sufficient automation (e.g., actuators, power supply, etc.) Thus, dosing electronics can only be used with suitably automated embodiments of the present dispenser. On the other hand, "alarm" electronics, which in some embodiments includes timer 806 and alarm 808, can be used in conjunction with substantially non-automated embodiments of the present dispenser.

It is understood that the functionality represented by processor 802, memory 804 and the timer and alarm may be suitably combined into fewer than four discrete devices. Those skilled in the art will know how to implement such dosing, alarm and monitoring electronics.

It is to be understood that the above-described embodiments are merely illustrative of the invention and that many variations can be devised by those skilled in the art without departing from the scope of the invention. It is therefore intended that such variations be included within the scope of the following claims and their equivalents.

We claim:

1. A dose dispenser comprising:

a main body for retaining a plurality of dosages, wherein: each of said dosages is provided in a stamp-like dosage form, and said plurality of dosages are collectively organized in a roll; and a dosage delivery port depending from said cylindrical main body and operative to receive said dosages from said cylindrical main body, wherein said dosage delivery port comprises:

an aperture;

an end wall in which said aperture is defined;

two side walls that join said end wall to said cylindrical main body; and a top wall that abuts said two said walls and said end wall.

2. The dose dispenser of claim 1, said top wall having an access way that extends from said aperture towards said cylindrical main body, wherein said access way has a size suitable for providing access by a user's finger to a dosage that is within said dosage delivery port.

3. The dose dispenser of claim 1, further comprising a drive mechanism that engages said dosages, wherein said drive mechanism is operative, when actuated, to drive said dosages through said aperture.

4. The dose dispenser of claim 3 wherein said drive mechanism is manually actuated by a crank that is driven by a user.

5. The dose dispenser of claim 3 wherein said drive mechanism is electrically actuated.

6. The dose dispenser of claim 5 further comprising a dispensing button that, when engaged by a user, causes said electrical actuation of said drive mechanism.

7. The dose dispenser of claim 6 wherein said drive mechanism comprises:

a first roller that abuts, in frictional engagement, a first surface of said dosages;

a second roller that abuts, in frictional engagement, a second surface of said dosages, wherein, said first and second rollers sandwich said dosages therebetween;

a motor that is operatively engaged to said first roller; and a power source for driving said motor.

8. The dose dispenser of claim 5 further comprising dosing electronics dosing electronics that are operable, in conjunction with said drive mechanism, to dispense said individual dosages at specified times or at specified time intervals.

9. The dose dispenser of claim 1 further comprising alarm electronics that alert a user that it is time to dispense a dosage.

10. The dose dispenser of claim 5 further comprising monitoring electronics that record dispensing statistics.

11. An article comprising:

a housing, wherein said housing is physically configured to retain a plurality of stamp-like dosage forms that are collectively organized in a roll;

a dosage delivery port, wherein said dosage delivery port depends from said housing and receives said dosage forms from said housing, wherein said dosage delivery port comprises:

an end wall;

an aperture, wherein said aperture is defined in said end wall;

two side walls, wherein said two side walls join said end wall to said housing; and a top wall, wherein said top wall abuts said two side walls and said end wall.

12. The article of claim 11 further comprising said plurality of stamp-like dosage forms that are collectively organized in a roll.

13. The article of claim 11 wherein said housing is cylindrical.

14. The article of claim 11 wherein:

said top wall has an access way;

said access way extends from said aperture towards said housing;

said access way is suitable sized to providing access by a user's finger to a dosage form that is within said dosage delivery port.

15. The article of claim 11 further comprising a drive mechanism, wherein said drive mechanism engages said dosages, and wherein, when said drive mechanism is actuated, it drives said dosages through said aperture.

16. The article of claim 15 further comprising dosing electronics, wherein said dosing electronics, in conjunction with said drive mechanism, dispenses at least one of said dosages forms at specified times or at specified time intervals.

17. The article of claim 15 further comprising further comprising monitoring electronics, wherein said monitoring electronics record dispensing statistics.

* * * * *